US011028978B2

(12) United States Patent
Fan et al.

(10) Patent No.: US 11,028,978 B2
(45) Date of Patent: Jun. 8, 2021

(54) LIGHT SOURCE MODULE AND ILLUMINATION DEVICE

(71) Applicant: OPPLE LIGHTING CO., LTD., Shanghai (CN)

(72) Inventors: Xiaoming Fan, Shanghai (CN); Zhixian Zhou, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/656,530

(22) Filed: Oct. 17, 2019

(65) Prior Publication Data

US 2020/0049316 A1 Feb. 13, 2020

Related U.S. Application Data

(63) Continuation of application No. PCT/CN2018/083218, filed on Apr. 16, 2018.

(30) Foreign Application Priority Data

Apr. 21, 2017 (CN) ..... 201710269180.7
Apr. 21, 2017 (CN) ..... 201720430026.9

(51) Int. Cl.
*F21K 9/62* (2016.01)
*F21K 9/90* (2016.01)
(Continued)

(52) U.S. Cl.
CPC ..... *F21K 9/62* (2016.08); *F21K 9/90* (2013.01); *F21S 2/00* (2013.01); *F21V 23/02* (2013.01);
(Continued)

(58) Field of Classification Search
CPC . F21V 23/02; F21S 2/00; H05B 46/00; F21K 9/62; F21K 9/90
See application file for complete search history.

(56) References Cited

U.S. PATENT DOCUMENTS 8,143,777 B2 * 3/2012 Takano ..... F21K 9/00 313/501
9,109,762 B2 * 8/2015 Yamakawa ..... H05B 45/20
(Continued)

FOREIGN PATENT DOCUMENTS

CN 105737090 A 7/2016
CN 105737091 A 7/2016
(Continued)

OTHER PUBLICATIONS

Chinese First Office Action (including English translation) issued in CN201710269180.7, dated Jan. 30, 2018, 6 pages.
(Continued)

*Primary Examiner* — Arman B Fallahkhair
(74) *Attorney, Agent, or Firm* — Arch & Lake LLP

(57) ABSTRACT

The present disclosure discloses a light source module and an illumination device using the light source module. The light source module includes at least one of a first light emitting body, a second light emitting body, and a third light emitting body, three light emitting bodies have different characteristics of luminescence. The light source module and the illumination device using the light source module, provided by the example of the disclosure, adjust a peak wavelength, a peak intensity and a color coordinate of a light emitting body in the light source module into a preset range.

20 Claims, 9 Drawing Sheets

Embodiment four: a mixed spectrum distribution of a first light emitting body and a third light emitting body Embodiment five: a mixed spectrum distribution of a second light emitting body and a third light emitting body

(51) Int. Cl.

| | |
|---|---|
| ***F21V 23/02*** | (2006.01) |
| ***F21S 2/00*** | (2016.01) |
| ***H05B 46/00*** | (2020.01) |
| *F21Y 113/13* | (2016.01) |
| *F21Y 115/10* | (2016.01) |
| *F21Y 115/15* | (2016.01) |
| *F21Y 113/10* | (2016.01) |

(52) U.S. Cl.
CPC ..... *H05B 46/00* (2020.01); *F21Y 2113/10* (2016.08); *F21Y 2113/13* (2016.08); *F21Y 2115/10* (2016.08); *F21Y 2115/15* (2016.08)

(56) References Cited

U.S. PATENT DOCUMENTS

2014/0340891 A1* 11/2014 Hyun ..... F21V 9/08 362/231
2015/0029713 A1* 1/2015 Fieberg ..... H05B 45/20 362/231
2015/0062869 A1* 3/2015 Son ..... F21K 9/64 362/84
2015/0062892 A1* 3/2015 Krames ..... F21K 9/64 362/231
2016/0141277 A1* 5/2016 Stoll ..... H01L 25/0753 362/231
2018/0343720 A1* 11/2018 Qiang ..... H05B 45/20

FOREIGN PATENT DOCUMENTS

| | | | |
|---|---|---|---|
| CN | 106958759 | A | 7/2017 |
| CN | 207065193 | U | 3/2018 |
| JP | 2015088241 | A | 5/2010 |

OTHER PUBLICATIONS

Chinese Second Office Action (including English translation) issued in CN201710269180.7, dated Sep. 26, 2018, 13 pages.
International Search Report (including English translation) and Written Opinion issued in PCT/CN2018/083218, dated Jul. 20, 2018, 10 pages.

* cited by examiner

LIGHT SOURCE MODULE AND ILLUMINATION DEVICE

CROSS-REFERENCE TO RELATED APPLICATIONS

This application is based upon and claims the priority of PCT patent application No. PCT/CN2018/083218 filed on Apr. 16, 2018 which claims the priority of Chinese Patent Application No. 201710269180.7 filed on Apr. 21, 2017, and Chinese Patent Application No. 201720430026.9 filed on Apr. 21, 2017, the entire content of all of which is hereby incorporated by reference herein for all purposes.

TECHNICAL FIELD

The present disclosure relates to a field of illumination technology, and in particular, to a light source module and an illumination device using the light source module.

BACKGROUND

Because most of elderly people have health problems such as degeneration of the eyes function and the like, and elderly people have poor ability of color discrimination, presbyopia and the like. Thus, there is a high performance requirement for an illumination device applied in the living environment of elderly people, and how to make the illumination device suitable for eye needs of elderly people has also become a focus.

SUMMARY

The present disclosure provides a light source module, an illumination device and a method of manufacturing a light source module.

The present disclosure provides a light source module. The light source module may include at least one of a first light emitting body, a second light emitting body, and a third light emitting body.

The first light emitting body may be configured to emit light rays having a first wave peak with a wavelength in a range of 435-465 nm and a second wave peak with a wavelength in a range of 620-650 nm, where a spectral intensity of the first wave peak may be 70-90% of a spectral intensity of the second wave peak, and a condition may be conformed in a CIE 1931 color coordinate system that an abscissa X is in a range of 0.389-0.419, and an ordinate Y is in a range of 0.371-0.401.

The second light emitting body may be configured to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak may be 25-45% of a spectral intensity of the first wave peak, and a spectral intensity of the third wave peak being 20-40% of the spectral intensity of the first wave peak, and a condition may be conformed in the CIE 1931 color coordinate system that an abscissa X is in a range of 0.280-0.310, and an ordinate Y is in a range of 0.284-0.314.

The third light emitting body may be configured to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak may be 45-65% of a spectral intensity of the first wave peak, and a spectral intensity of the third wave peak being 40-60% of the spectral intensity of the first wave peak, and a condition may be conformed in the CIE 1931 color coordinate system that an abscissa X is in a range of 0.331-0.361, and an ordinate Y is in a range of 0.331-0.361.

The present disclosure provides an illumination device. The illumination device may include a housing; a light source module; a base body of the light source module being installed to the housing; and a power module electrically connected to the light source module to provide power required by working for the light source module. The light source module may include at least one of a first light emitting body, a second light emitting body, and a third light emitting body.

The first light emitting body may be configured to emit light rays having a first wave peak with a wavelength in a range of 435-465 nm and a second wave peak with a wavelength in a range of 620-650 nm, where a spectral intensity of the first wave peak may be 70-90% of a spectral intensity of the second wave peak, and a condition may be conformed in a CIE 1931 color coordinate system that an abscissa X is in a range of 0.389-0.419, and an ordinate Y is in a range of 0.371-0.401.

The second light emitting body may be configured to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak may be 25-45% of a spectral intensity of the first wave peak, and a spectral intensity of the third wave peak being 20-40% of the spectral intensity of the first wave peak, and a condition may be conformed in the CIE 1931 color coordinate system that an abscissa X is in a range of 0.280-0.310, and an ordinate Y is in a range of 0.284-0.314.

The third light emitting body may be configured to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak may be 45-65% of a spectral intensity of the first wave peak, and a spectral intensity of the third wave peak being 40-60% of the spectral intensity of the first wave peak, and a condition may be conformed in the CIE 1931 color coordinate system that an abscissa X is in a range of 0.331-0.361, and an ordinate Y is in a range of 0.331-0.361.

The present disclosure also provides a method of manufacturing a light source module. The method may include: providing at least one of a first light emitting body, a second light emitting body, and a third light emitting body; and configuring the first light emitting body to emit light rays having a first wave peak with a wavelength in a range of 435-465 nm and a second wave peak with a wavelength in a range of 620-650 nm, where a spectral intensity of the first wave peak is 70-90% of a spectral intensity of the second wave peak, and a condition is conformed in an International Commission on Illumination (CIE) 1931 color coordinate system that an abscissa X is in a range of 0.389-0.419, and an ordinate Y is in a range of 0.371-0.401.

The method may also include configuring the second light emitting body to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak is 25-45% of a spectral intensity of the first wave peak, and a spectral intensity of the third wave peak is 20-40% of the spectral intensity of the first wave peak, and a condition is conformed in the CIE 1931 color coordinate system that an abscissa X is in a range of 0.280-0.310, and an ordinate Y is in a range of 0.284-0.314; and configuring the third light emitting body to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak is 45-65% of a spectral intensity of the first wave peak, and a spectral intensity of the third wave peak is 40-60% of the spectral intensity of the first wave peak, and a condition is conformed in the CIE 1931 color coordinate system that an abscissa X is in a range of 0.331-0.361, and an ordinate Y is in a range of 0.331-0.361.

It is to be understood that both the foregoing general description and the following detailed description are exemplary and explanatory only and are not restrictive of the present disclosure.

BRIEF DESCRIPTION OF THE DRAWINGS

In order to more clearly illustrate examples of the present disclosure, the drawings required to be used in the examples will be briefly introduced below. It is evidently that the drawings in the following description are only some examples recorded in the present disclosure, and for those skilled in the art, other drawings can also be obtained in accordance with these accompanying drawings without any creative efforts.

DETAILED DESCRIPTION

In order to make those skilled in the art better understand technical solutions in the present disclosure, the technical solutions in examples of the present disclosure will be clearly and completely described in combination with the accompanying drawings in the examples of the present disclosure. Evidently, the described examples are only a part of the examples of the present disclosure, and not all of the examples. All further examples obtained by those skilled in the art based on the examples of the present disclosure without creative efforts should fall into the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Sometimes, illuminating light emitted by the illumination device may be generally set according to eye needs of young people, such illumination device does not meet the eye needs of elderly people, and even damages the eye health of elderly people. Therefore, it is necessary to propose an illumination device suitable for the living environments of elderly people.

Figure 1:
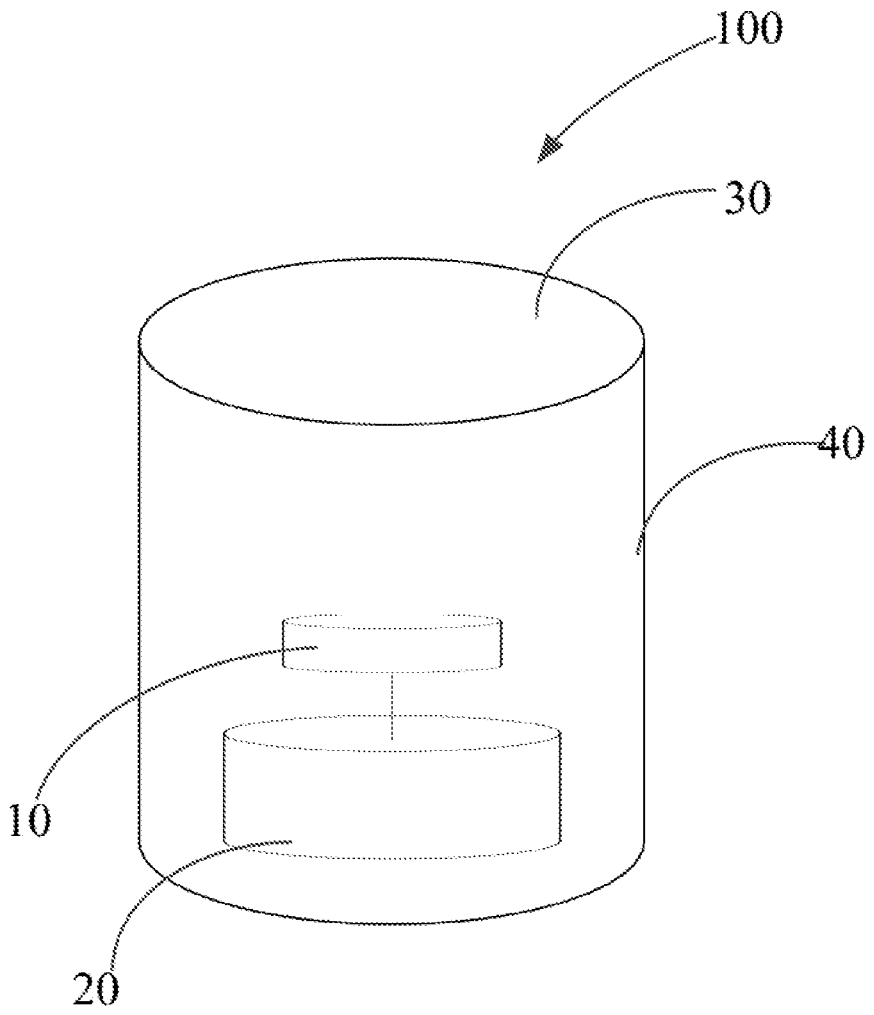
FIG. 1 is a schematic structural view of an illumination device according to an example of the present disclosure.

As shown in FIG. 1, in an example of the present disclosure, an illumination device 100 includes a light source module 10, a power module 20 connected to the light source module 10, an optical element 30 located on an exiting light path of the light source module 10, and a housing 40 for supporting the foregoing light source module 10, the power module 20, and the optical element 30.

The power module 20 includes a conventional module for such as voltage adjustment, current adjustment, over discharge protection, over current protection and the like. A driver heat dissipation module 20 after obtaining external currents such as commercial power, transmits the external currents to the light source module 10, so that the light source module 10 emits light rays. The optical element 30 can be a lens or a diffusion plate, which is not described herein.

The light source module 10 can include at least one of a first light emitting body 11, a second light emitting body 12, and a third light emitting body 13, and the light source module 10 also include a base body 14 for supporting the foregoing light emitting body. The first light emitting body 11, the second light emitting body 12, and the third light emitting body 13 can be individual light emitting units or a module composed of a plurality of light emitting units. The light emitting unit can be a light emitting diode (LED) unit in which a Blue-led excits fluorescence, a color LED unit, an organic light emitting diode (OLED), or Quantum Dot (QD) luminescent device, which is not described herein. The base body 14 can include a pedestal (not shown) for locating a position of the light emitting body, and a terminal (not shown) electrically connected with the light emitting body, and so that the light source module 10 can be installed into the light source module 100 by the base body 14, and the terminal in the light source module 10 can be electrically connected with a driver component after installation.

Figure 2:
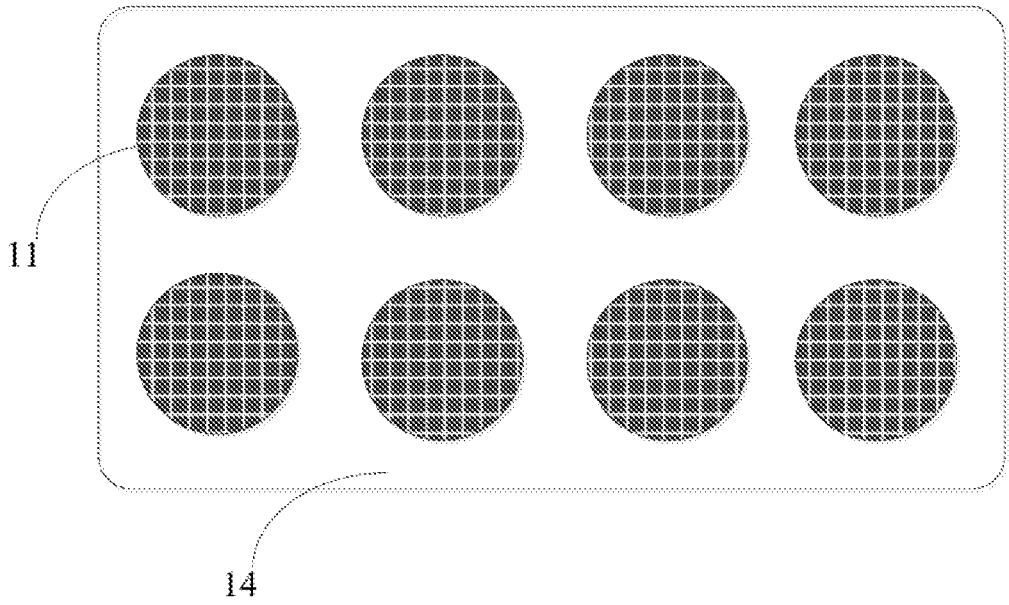
FIG. 2 is a schematic view of a light source module only including a first light emitting body according to a first example of the present disclosure.
Figure 3:
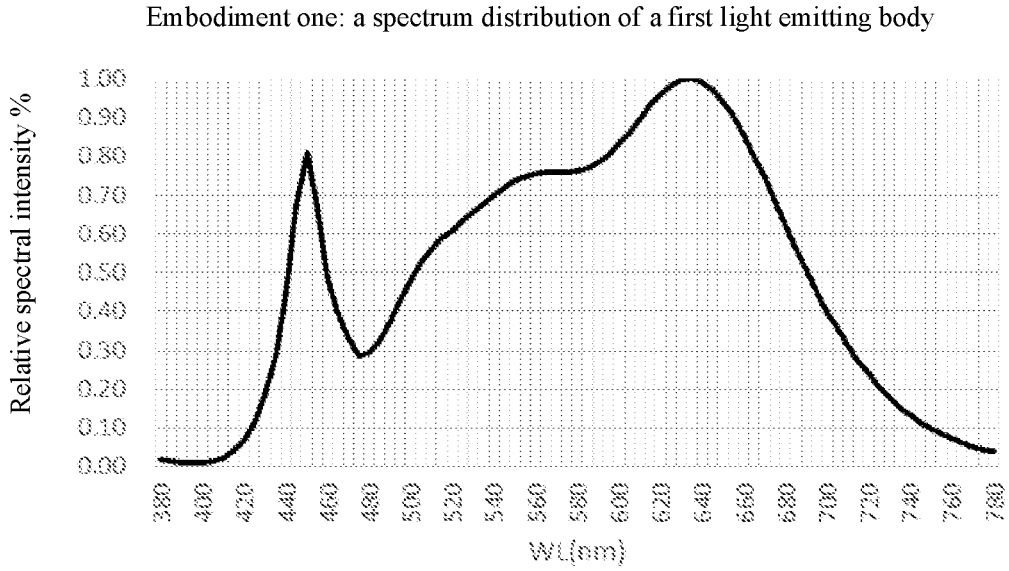
FIG. 3 is a spectrum graph of light rays emitted by the light source module shown in FIG. 2.
Figure 12:
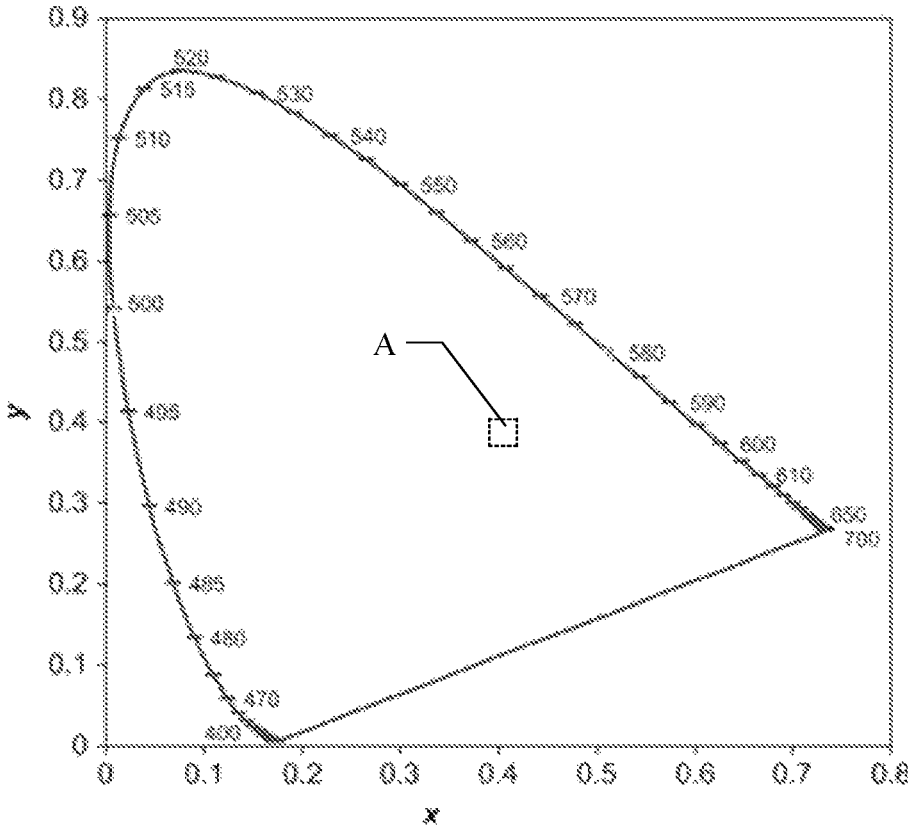
FIG. 12 is schematic diagram showing a range of coordinates in a CIE 1931 color coordinate system according to an example of the present disclosure.

As shown in FIG. 2 and FIG. 3, in a first example of the present disclosure, a light source module 10 only includes a first light emitting body 11, and the first light emitting body 11 can emit light rays after obtaining power transmitted by a power module via a driver component. Specifically, the light rays emitted by the first light emitting body 11 have following features that a first wave peak with a wavelength is in a range of 435-465 nm, and a second wave peak with a wavelength is in a range of 620-650 nm; and a spectral intensity of a first wave peak is 70-90% of a spectral intensity of a second wave peak; and the light rays conform to a condition in a CIE 1931 color coordinate system that an abscissa X is in a range of 0.389-0.419, and an ordinate Y is in a range of 0.371-0.401, as indicated by region A in FIG. 12.

In combination with technical reports CIE170-1-2006 and CIE170-2-2015 of the International Commission on Illumination CIE, a relationship between response curves of three kinds of visual photoreceptor cells and variation of ages is described, thereby determining the response curves of visual photoreceptor cells of elderly people aged 65-year or older, and determining the number of wave peaks, peak wavelength ranges of the wave peaks, spectral intensities of the wave peaks, and a color coordinate range of the first light emitting body 11, according to the determined response curves of visual photoreceptor cells of elderly people, so that illuminating light emitted by the illumination device can match the response curves of visual photoreceptor cells of elderly people, and then the illumination device can well improve the color discrimination ability, comfort and reading accuracy of eyes of elderly people, and is obviously superior in comparison with the illumination device having ordinary hue and illuminance.

In this example, the light rays emitted by the first light emitting body have the first wave peak with the wavelength preferably in a range of 445-455 nm and the second wave peak with the wavelength preferably in a range of 630-640 nm. Furthermore, the first wave peak with the wavelength is 450 nm, and the second wave peak with the wavelength is 635 nm. In addition, the spectral intensity of the first wave peak of the light rays emitted by the first light emitting body is preferably in a range of 77.1%-87.1% of the spectral intensity of the second wave peak. Furthermore, the spectral intensity of the first wave peak is 82.1% of the spectral intensity of the second wave peak.

In this example, the light rays emitted by the first light emitting body can also further be optimized to meet a condition in the CIE 1931 color coordinate system that the abscissa X is in a range of 0.394-0.414, and the ordinate Y is in a range of 0.376-0.396. Furthermore, the light rays emitted by the first light emitting body can also be optimized to meet a condition in the CIE 1931 color coordinate system that the abscissa X is in a range of 0.399-0.409, and the ordinate Y is in a range of 0.381-0.391. Still further, the light rays emitted by the first light emitting body meet a condition in the CIE 1931 color coordinate system that the abscissa X is 0.3996, and the ordinate Y is 0.3805.

As shown in FIG. 3, the second wave peak of the light rays emitted by the first light emitting body 11 has a spectral half-width in a range of 65-85 nm or 95-115 nm. In this example, the second wave peak of the light rays emitted by the first light emitting body 11 has the spectral half-width in a range of 95-99.5 nm.

The light rays emitted by the first light emitting body have continuous spectrum in a range of 485-590 nm, and a spectral intensity of the light rays located in that range is not less than an arbitrary value in a range of 25%-35% of the spectral intensity of the second wave peak. Preferably, the spectral intensity of the light rays located in that range is at least 30% of the spectral intensity of the second wave peak. In this example, the light rays emitted by the first light emitting body 11 have the spectral intensity within the range of 485-590 nm being at least 32.5% of the spectral intensity of the second wave peak.

Also, the light rays emitted by the first light emitting body 11 have a chromaticity distortion in a range of −0.006-0.002. The light rays emitted by the first light emitting body 11 have a color temperature in a range of 3347-3747 K, and a color rendering index CRI in a range of 90-99.7. Illuminating light emitted by the first light emitting body has an illuminance in a range of 100-1000 lux.

Figure 4:
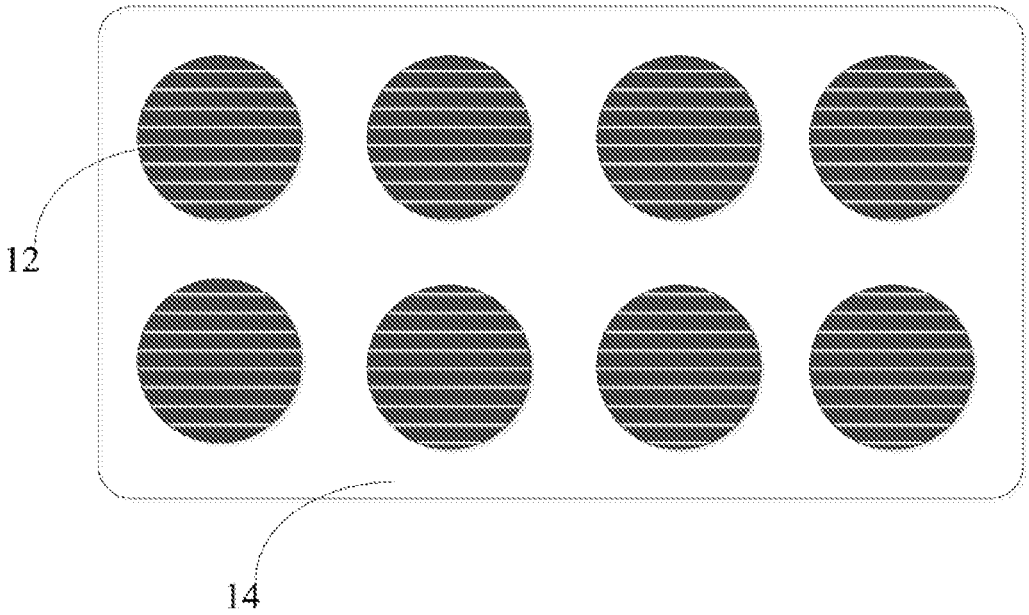
FIG. 4 is a schematic view of a light source module only including a second light emitting body according to a second example of the present disclosure.
Figure 5:
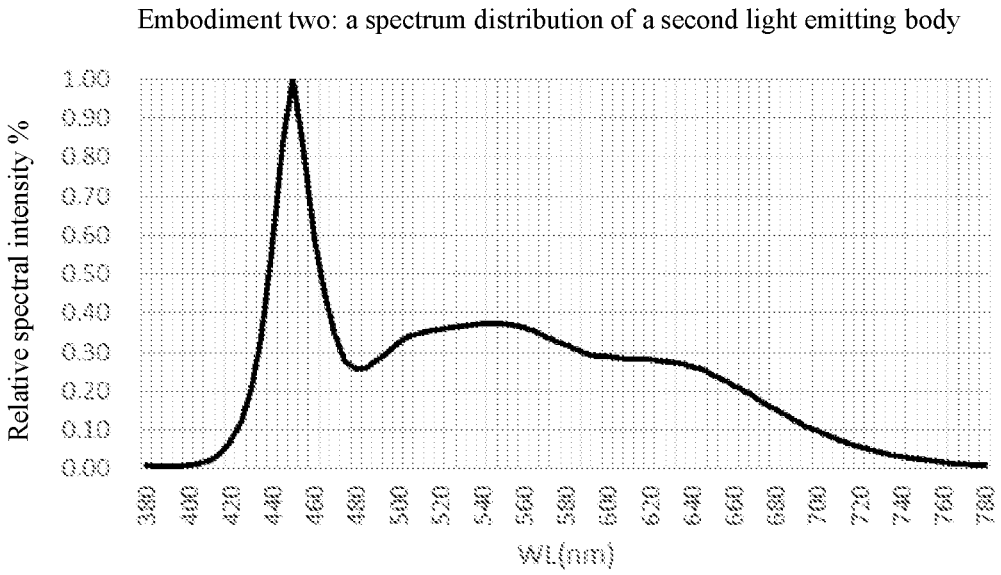
FIG. 5 is a spectrum graph of light rays emitted by the light source module shown in FIG. 4.
Figure 13:
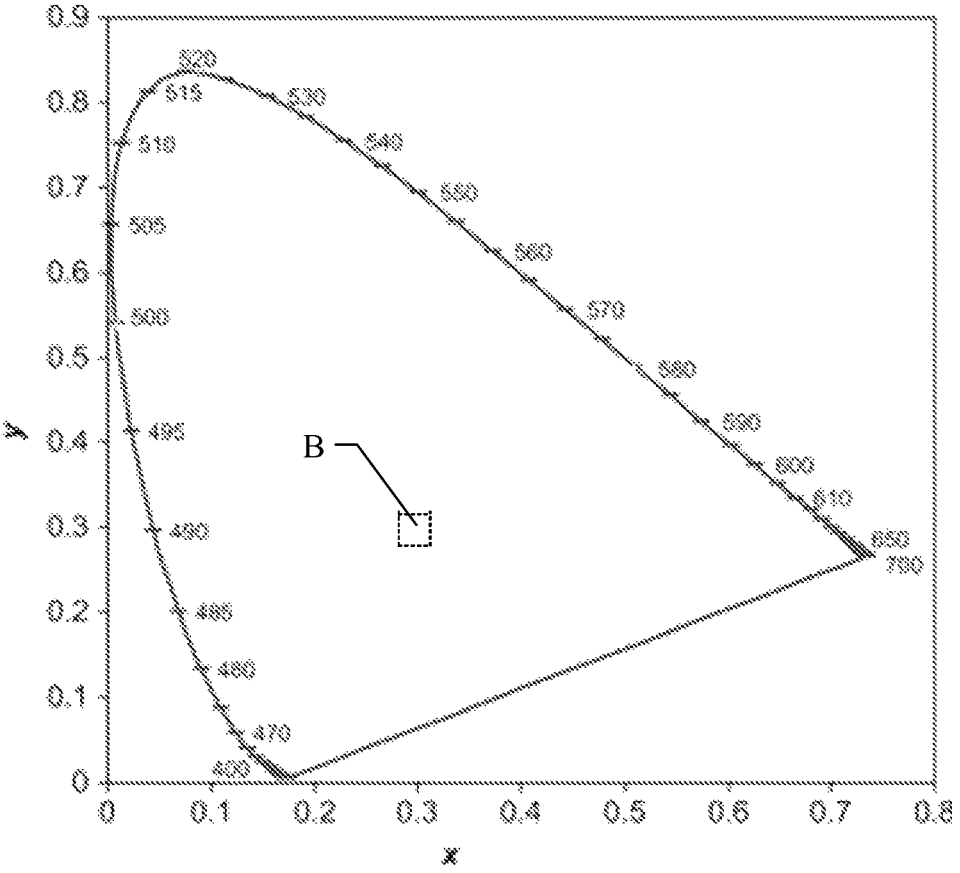
FIG. 13 is schematic diagram showing a range of coordinates in a CIE 1931 color coordinate system according to an example of the present disclosure.

As shown in FIG. 4 and FIG. 5, in a second example of the present disclosure, a light source module 10 only includes a second light emitting body 12, and the second light emitting body 12 can emit light rays after obtaining the power transmitted by a power module via a driver component. Specifically, the light rays emitted by the second light emitting body 12 have the following features that a first wave peak with a wavelength is in a range of 435-465 nm, a second wave peak with a wavelength is in a range of 525-555 nm, and a third wave peak with a wavelength is in a range of 620-650 nm; and a spectral intensity of a second wave peak is 25-45% of a spectral intensity of a first wave peak, and a spectral intensity of a third wave peak is 20-40% of the spectral intensity of the first wave peak; and the light rays conform to a condition in CIE 1931 color coordinate system that an abscissa X is in a range of 0.280-0.310, and an ordinate Y is in a range of 0.284-0.314, as indicated by region B in FIG. 13.

Similarly, in combination with technical reports CIE170-1-2006 and CIE170-2-2015 of the International Commission on Illumination CIE, a relationship between response curves of three kinds of visual photoreceptor cells and variation of ages is described, thereby determining the response curves of visual photoreceptor cells of elderly people aged 65-year or older, and determining the number of wave peaks, peak wavelength ranges of the wave peaks, spectral intensities of the wave peaks, and a color coordinate range of the second light emitting body 12, according to the determined response curves of visual photoreceptor cells of elderly people, so that illuminating light emitted by the illumination device can match the response curves of visual photoreceptor cells of elderly people, and then the illumination device can well improve the color discrimination ability, comfort and reading accuracy of eyes of elderly people, and is obviously superior in comparison with the illumination device having ordinary hue and illuminance.

In this example, the light rays emitted by the second light emitting body 12 have a first peak wavelength preferably in a range of 445-455 nm, a second peak wavelength preferably in a range of 535-545 nm, and a third peak wavelength preferably in a range of 630-640 nm. Furthermore, the light rays emitted by the second light emitting body 12 have the first wave peak with the wavelength of 450 nm, the second wave peak with the wavelength of 540 nm, and the third wave peak with the wavelength of 635 nm. Also, the light rays emitted by the second light emitting body have the spectral intensity of the second wave peak in a range of 31.5%-42.5% of the spectral intensity of the first wave peak, and the spectral intensity of the third wave peak in a range of 15.6%-26.6% of the spectral intensity of the first wave peak. Still further, the light rays emitted by the second light emitting body have the spectral intensity of the second wave peak being 37.5% of the spectral intensity of the first wave peak, and the spectral intensity of the third wave peak being 21.6% of the spectral intensity of the first wave peak.

In this example, the light rays emitted by the second light emitting body 12 can also further be optimized to conform to a condition in the CIE 1931 color coordinate system that the abscissa X is in a range of 0.285-0.305, and the ordinate Y is in a range of 0.289-0.309. Furthermore, the light rays emitted by the second light emitting body 12 conform to a condition in the CIE 1931 color coordinate system that the abscissa X is in a range of 0.290-0.300, and the ordinate Y is in a range of 0.294-0.304. Still further, the light rays emitted by the second light emitting body 12 conform to a condition in the CIE 1931 color coordinate system that the abscissa X is 0.2922, and the ordinate Y is 0.2940.

As shown in FIG. 5, the second wave peak of the light rays emitted by the second light emitting body 12 has a spectral half-width in a range of 80-100 nm or in a range of 110-130 nm; the third wave peak of the light rays emitted by the second light emitting body 12 has a spectral half-width in a range of 65-85 nm or in a range of 95-115 nm. In this example, the second wave peak of the light rays emitted by the second light emitting body 12 has the spectral half-width in a range of 110-116 nm; and the third wave peak of the light rays emitted by the second light emitting body 12 has the spectral half-width in a range of 95-99.5 nm.

In a practical application, the light rays emitted by the second light emitting body have continuous spectrum in a range of 620-650 nm, and a spectral intensity of the light rays located in that range is not less than an arbitrary value in a range of 15%-25% of the spectral intensity of the first wave peak. Preferably, the spectral intensity of the light rays located in that range is at least 20% of the spectral intensity of the first wave peak. Preferably, the light rays emitted by the second light emitting body have the spectral intensity within the range of 620-650 nm being at least 21.6% of the spectral intensity of the first wave peak.

Also, the light rays emitted by the second light emitting body have a color temperature in a range of 7968-8868K, and a color rendering index CRI in a range of 90-96.7. Illuminating light emitted by the light emitting body has an illuminance in a range of 100-1000 lux.

Figure 6:
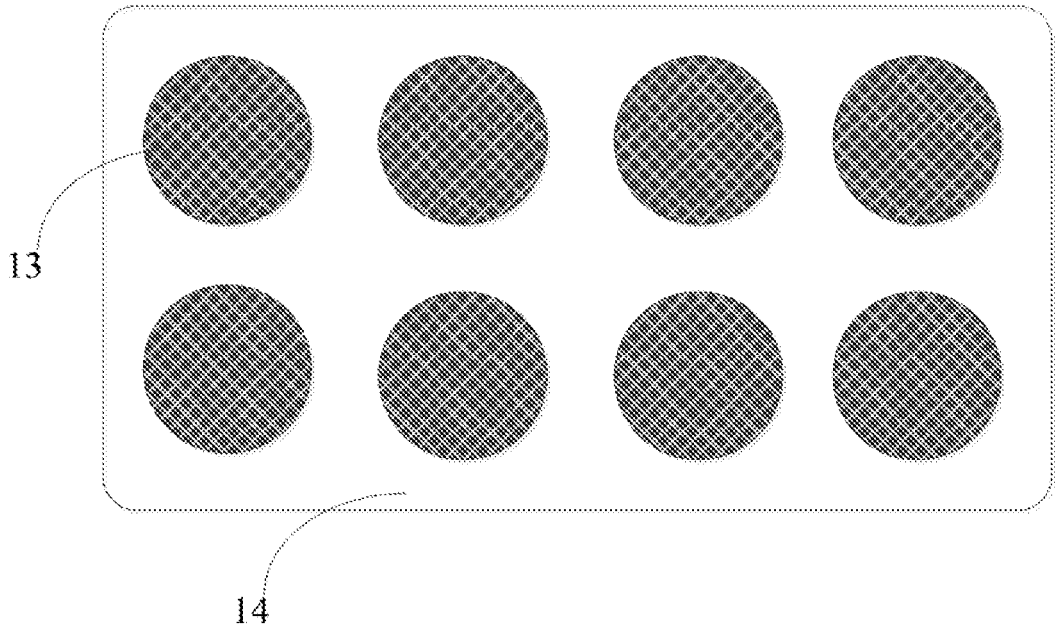
FIG. 6 is a schematic view of a light source module only including a third light emitting body according to a third example of the present disclosure.
Figure 7:
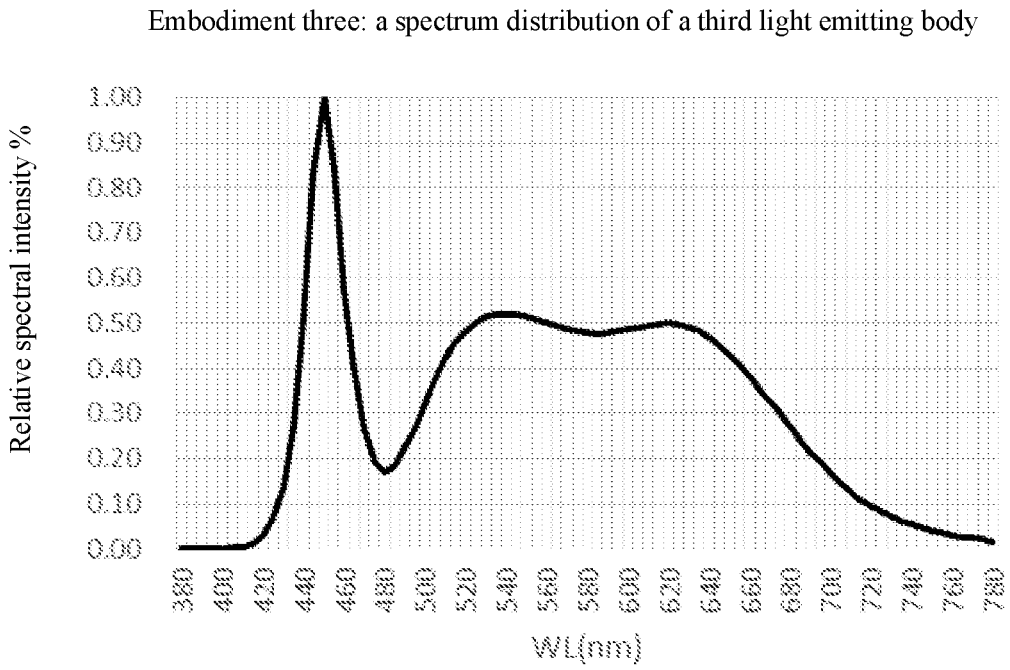
FIG. 7 is a spectrum graph of light rays emitted by the light source module shown in FIG. 6.
Figure 14:
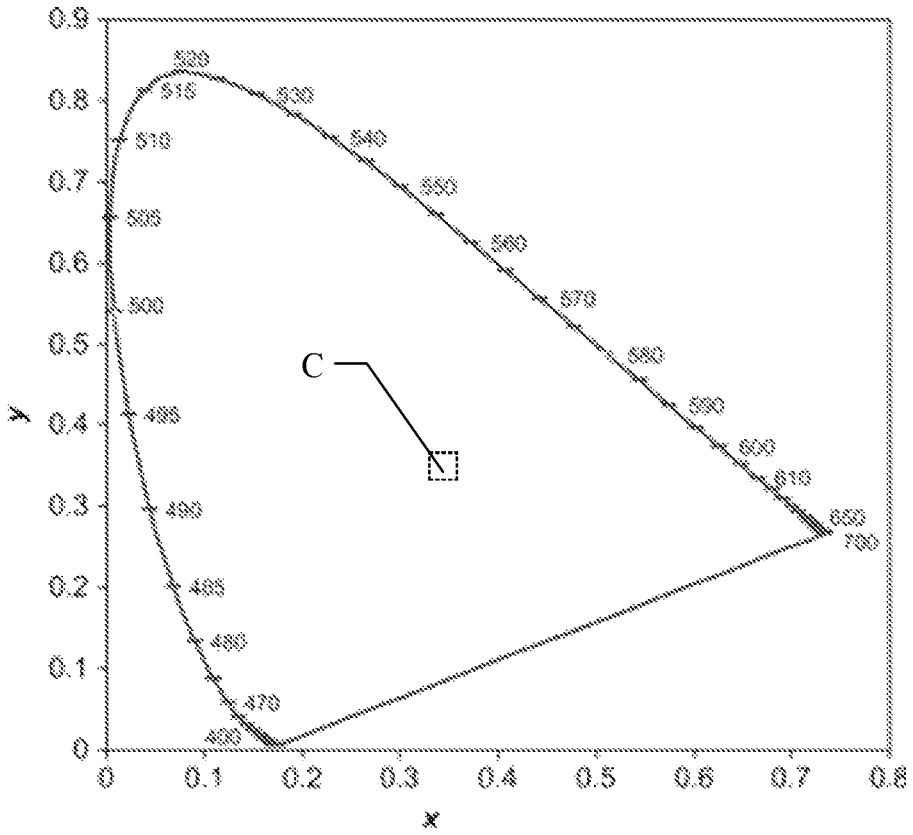
FIG. 14 is schematic diagram showing a range of coordinates in a CIE 1931 color coordinate system according to an example of the present disclosure.

As shown in FIG. 6 and FIG. 7, in a third example of the present disclosure, a light source module 10 only includes a third light emitting body 13, and the third light emitting body 13 can emit light rays after obtaining the power transmitted by a power module via a driver component. Specifically, the light rays emitted by the third light emitting body 13 have the following features that a first wave peak with a wavelength is in a range of 435-465 nm, a second wave peak with a wavelength is in a range of 525-555 nm, and a third wave peak with a wavelength is in a range of 620-650 nm; and a spectral intensity of a second wave peak is 45-65% of a spectral intensity of a first wave peak, and a spectral intensity of a third wave peak is 40-60% of the spectral intensity of the first wave peak; and the light rays conform to a condition in CIE 1931 color coordinate system that an abscissa X is in a range of 0.331-0.361, and an ordinate Y is in a range of 0.331-0.361, as indicated by region C in FIG. 14.

Similarly, in combination with technical reports CIE170-1-2006 and CIE170-2-2015 of the International Commission on Illumination CIE, a relationship between response curves of three kinds of visual photoreceptor cells and variation of ages is described, thereby determining the response curves of visual photoreceptor cells of elderly people aged 65-year or older, and determining the number of wave peaks, peak wavelength ranges of the wave peaks, spectral intensities of the wave peaks, and a color coordinate range of the third light emitting body 13, according to the determined response curves of visual photoreceptor cells of elderly people, so that illuminating light emitted by the illumination device can match the response curves of visual photoreceptor cells of elderly people, and then the illumination device can well improve the color discrimination ability, comfort and reading accuracy of eyes of elderly people, and is obviously superior in comparison with the illumination device having ordinary hue and illuminance.

In this example, the light rays emitted by the third light emitting body 13 have the first wave peak with the wavelength preferably in a range of 445-455 nm, the second wave peak with the wavelength preferably in a range of 535-545 nm, and the third wave peak with the wavelength preferably in a range of 615-625 nm. Furthermore, the light rays emitted by the third light emitting body 13 have the first wave peak with the wavelength of 450 nm, the second wave peak with the wavelength of 540 nm, and the third wave peak with the wavelength of 635 nm. Also, the light rays emitted by the third light emitting body have a spectral intensity of a second wave peak in a range of 47.1%-57.1% of a spectral intensity of a first wave peak, and a spectral intensity of a third wave peak in a range of 44.9%-54.9% of the spectral intensity of the first wave peak. Still further, the light rays emitted by the second light emitting body have the spectral intensity of the second wave peak being 52.1% of the spectral intensity of the first wave peak, and the spectral intensity of the third wave peak being 49.9% of the spectral intensity of the first wave peak.

In this example, the light rays emitted by the third light emitting body 13 can also further be optimized to conform to a condition in the CIE 1931 color coordinate system that the abscissa X is in a range of 0.336-0.356, and the ordinate Y is in a range of 0.336-0.356. Furthermore, the light rays emitted by the third light emitting body 13 conform to a condition in the CIE 1931 color coordinate system that the abscissa X is in a range of 0.341-0.351, and the ordinate Y is in a range of 0.341-0.351. Still further, the light rays emitted by the third light emitting body 13 conform to a condition in the CIE 1931 color coordinate system that the abscissa X is 0.3435, and the ordinate Y is 0.3426.

As shown in FIG. 7, the second wave peak of the light rays emitted by the third light emitting body 13 has a spectral half-width in a range of 80-100 nm or in a range of 110-130 nm; the third wave peak of the light rays emitted by the third light emitting body 13 has a spectral half-width in a range of 65-85 nm or in a range of 95-115 nm. In an example, the second wave peak of the light rays emitted by the third light emitting body 13 has the spectral half-width in a range of 110-116 nm; and the third wave peak of the light rays emitted by the third light emitting body 13 has the spectral half-width in a range of 95-99.5 nm.

In a practical application, the light rays emitted by the second light emitting body have continuous spectrum in a range of 595-660 mm, and a spectral intensity of the light rays located in that range is not less than an arbitrary value in a range of 25%-35% of the spectral intensity of the first wave peak. Preferably, the spectral intensity of the light rays located in that range is at least 30% of the spectral intensity of the first wave peak. Preferably, the light rays emitted by the second light emitting body have the spectral intensity within the range of 595-660 mm being at least 38.1% of the spectral intensity of the first wave peak.

Also, the light rays emitted by the third light emitting body have a color temperature in a range of 4778-5278K, and a color rendering index CRI in a range of 90-94.5. Preferably, the light rays emitted by the second light emitting body have the color temperature of 5028 K, and the color rendering index CRI of 91.5. Illuminating light emitted by the second light emitting body have an illuminance in a range of 100-1000 lux.

Figure 8:
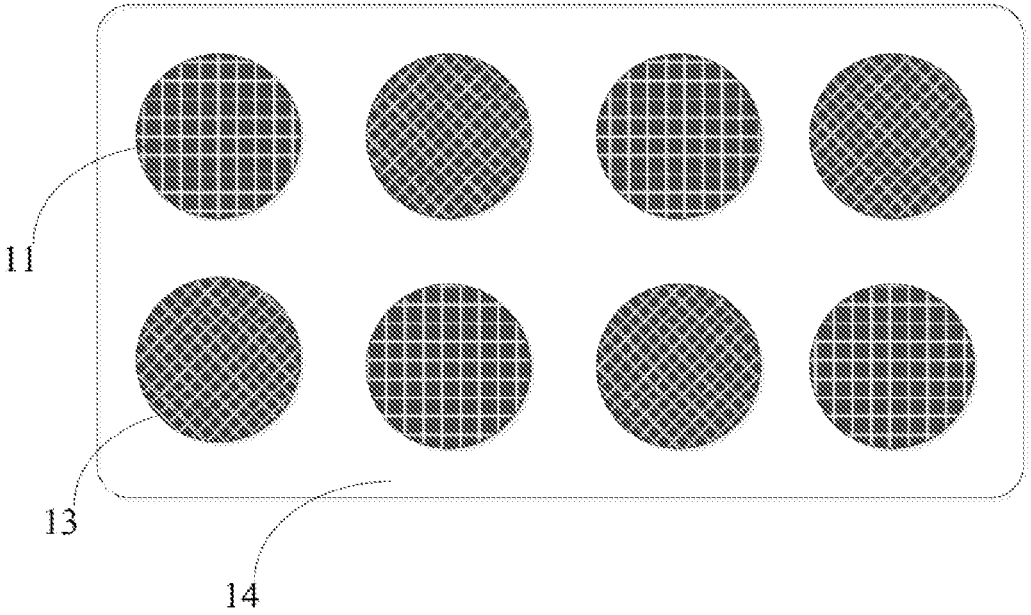
FIG. 8 is a schematic view of a light source module including a first light emitting body and a third light emitting body according to a fourth example of the present disclosure.
Figure 9:
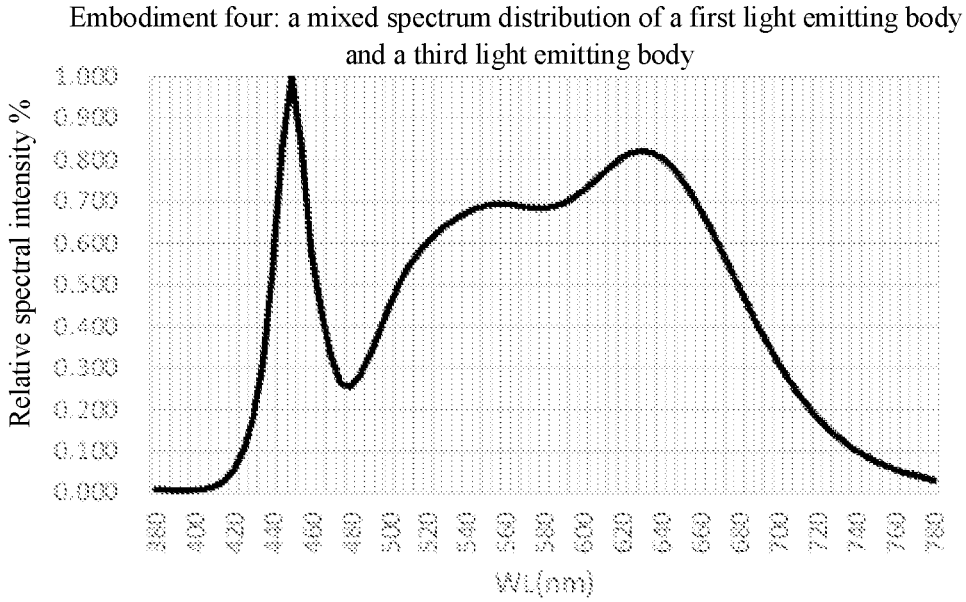
FIG. 9 is a spectrum graph of light rays emitted by the light source module shown in FIG. 8.

As shown in FIG. 8 and FIG. 9, in a fourth example of the present disclosure, a light source module 10 includes both a first light emitting body 11 and a third light emitting body 13, and characteristics of the light rays emitted by the first light emitting body 11 and the third light emitting body 13 can refer to the foregoing contents, and are not described in details herein.

In this example, upon the light source module 10 being applied to an illumination device 100, currents supplied to the first light emitting body 11 and the third light emitting body 13 in the light source module 10 can be adjusted by a power module 20 in the illumination device 100, so as to selectively light up at least one of the first light emitting body 11 and the third light emitting body 13.

Also, in a case where both the first light emitting body 11 and the third light emitting body 13 are lit up, spectral energy output by the first light emitting body 11 is not less than 30% of maximum spectral energy that can be output by the first light emitting body, and spectral energy output by the third light emitting body 13 is not less than 30% of maximum spectral energy that can be output by the third light emitting body. In a practical application, it is possible to realize the foregoing energy ratio by means of adjustment of duty ratio of the currents transmitted to the two light emitting bodies by the power module 20. For example, the current transmitted to the first light emitting body 11 by the power module 20 has the duty ratio in a range of 30% to 100%, and the current transmitted to the third light emitting body 13 by a driver module has the duty ratio in a range of 100% to 30%. In this example, the duty ratio of the current of the first light emitting body 11 is disposed to be equal to that of the third light emitting body 13, for example, the duty ratio is 50%.

As shown in FIG.9, after mixture of the light rays emitted by both the first light emitting body 11 and the third light emitting body 13, the light rays conform to a condition in the CIE 1931 color coordinate system that an abscissa X is 0.3760, and an ordinate Y is 0.3645; a color temperature is 4042 K, and a color rendering index CRI is 95.1.

Similarly, in combination with technical reports CIE170-1-2006 and CIE170-2-2015 of the International Commission on Illumination CIE, a relationship between response curves of three kinds of visual photoreceptor cells and variation of ages is described, thereby determining the response curves of visual photoreceptor cells of elderly people aged 65-year or older, and determining the number of wave peaks, peak wavelength ranges of the wave peaks, spectral intensities of the wave peaks, and a color coordinate range of the first light emitting body 11 and the second light emitting body 12, according to the determined response curves of visual photoreceptor cells of elderly people, so that illuminating light emitted by the illumination device can match the response curves of visual photoreceptor cells of elderly people, and then the illumination device can well improve the color discrimination ability, comfort and reading accuracy of eyes of elderly people, and is obviously superior in comparison with the illumination device having ordinary hue and illuminance.

Figure 10:
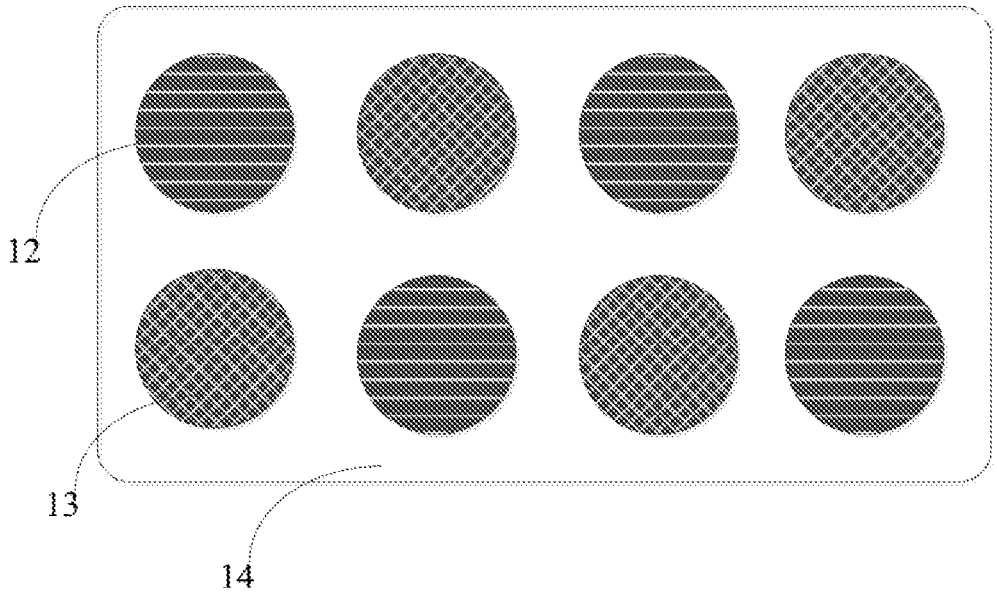
FIG. 10 is a schematic view of a light source module including a second light emitting body and a third light emitting body according to a fifth example of the present disclosure.
Figure 11:
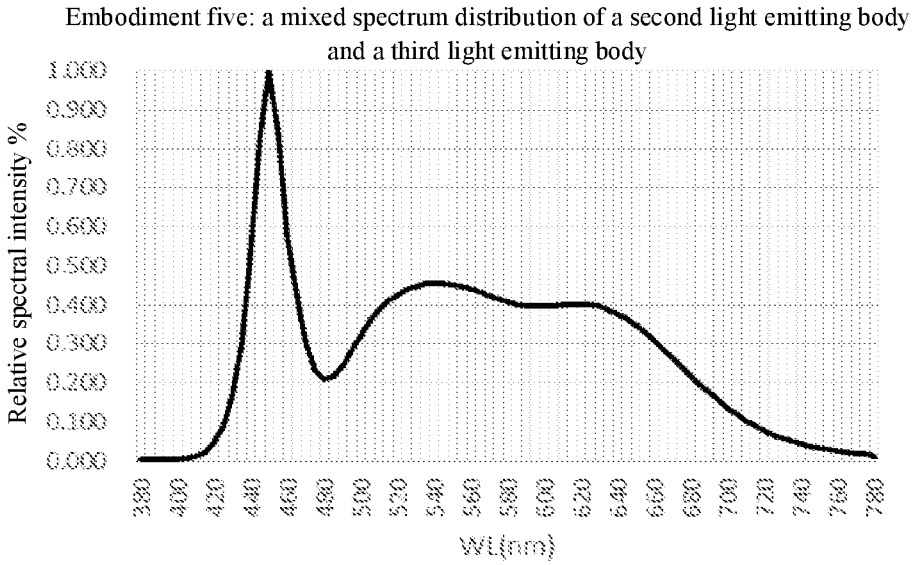
FIG. 11 is a spectrum graph of rays emitted by the light source module shown in FIG. 10.

As shown in FIG. 10 and FIG. 11, in a fifth example of the present disclosure, a light source module 10 includes both a second light emitting body 12 and a third light emitting body 13, and characteristics of light rays emitted by the second light emitting body 12 and the third light emitting body 13 can refer to the foregoing contents, and are not described in details herein.

In this example, upon the light source module 10 being applied to an illumination device 100, the currents supplied to the second light emitting body 12 and the third light emitting body 13 in the light source module 10 can be adjusted by a power module 20 in the illumination device 100, so as to selectively light up at least one of the second light emitting body 12 and the third light emitting body 13.

Also, in a case where both the second light emitting body 12 and the third light emitting body 13 are lit up, spectral energy output by the third light emitting body is not less than 30% of maximum spectral energy that can be output by the third light emitting body, and spectral energy output by the second light emitting body is not less than 30% of maximum spectral energy that can be output by the second light emitting body. In a practical application, it is possible to realize the foregoing energy ratio by means of adjustment of duty ratio of the currents transmitted to the two light emitting bodies by the power module 20. For example, the current transmitted to the third light emitting body 13 by the power module 20 has the duty ratio in a range of 30% to 100%, and the current transmitted to the second light emitting body 12 by a driver module has the duty ratio in a range of 100% to 30%. In this example, the duty ratio of the current of the second light emitting body 12 is disposed to be equal to that of the third light emitting body 13.

As shown in FIG. 11, after mixture of the light rays emitted by both the second light emitting body 12 and the third light emitting body 13, the light rays conform to a condition in the CIE 1931 color coordinate system that an abscissa X is 0.3231, and an ordinate Y is 0.3233; a color temperature is 5937 K, and a color rendering index CRI is 92.3.

Similarly, in combination with technical reports CIE170-1-2006 and CIE170-2-2015 of the International Commission on Illumination CIE, a relationship between response curves of three kinds of visual photoreceptor cells and variation of ages is described, thereby determining the response curves of visual photoreceptor cells of elderly people aged 65-year or older, and determining the number of wave peaks, peak wavelength ranges of the wave peaks, spectral intensities of the wave peaks, and a color coordinate range of the first light emitting body 11 and the second light emitting body 12, according to the determined response curves of visual photoreceptor cells of elderly people, so that illuminating light emitted by the illumination device can match the response curves of visual photoreceptor cells of elderly people, and then the illumination device can well improve the color discrimination ability, comfort and reading accuracy of eyes of elderly people, and is obviously superior in comparison with the illumination device having ordinary hue and illuminance.

An object of an example of the present disclosure is proposing a light source module and an illumination.

An example of the present disclosure provides a light source module. The light source module may include at least one of a first light emitting body, a second light emitting body, and a third light emitting body.

The first light emitting body may be configured to emit light rays having a first wave peak with a wavelength in a range of 435-465 nm and a second wave peak with a wavelength in a range of 620-650 nm, where a spectral intensity of the first wave peak may be 70-90% of a spectral intensity of the second wave peak, and a condition may be conformed in a CIE 1931 color coordinate system that an abscissa X is in a range of 0.389-0.419, and an ordinate Y is in a range of 0.371-0.401.

The second light emitting body may be configured to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak may be 25-45% of a spectral intensity of the first wave peak, and a spectral intensity of the third wave peak being 20-40% of the spectral intensity of the first wave peak, and a condition may be conformed in the CIE 1931 color coordinate system that an abscissa X is in a range of 0.280-0.310, and an ordinate Y is in a range of 0.284-0.314.

The third light emitting body may be configured to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak may be 45-65% of a spectral intensity of the first wave peak, and a spectral intensity of the third wave peak being 40-60% of the spectral intensity of the first wave peak, and a condition may be conformed in the CIE 1931 color coordinate system that an abscissa X is in a range of 0.331-0.361, and an ordinate Y is in a range of 0.331-0.361.

It is possible, the light source module of above described, where the light rays emitted by the second light emitting body have the spectral intensity of the second wave peak in a range of 31.5%-42.5% of the spectral intensity of the first wave peak, and the spectral intensity of the third wave peak in a range of 15.6%-26.6% of the spectral intensity of the first wave peak.

It is possible, the light source module of above described, where a spectral half-width of the third wave peak of the light rays emitted by the second light emitting body is in a range of 65-85 nm or in a range of 95-115 nm. It is also possible, the spectral half-width of the third wave peak of the light rays emitted by the second light emitting body is in a range of 95-99.5 nm.

It is possible, the light source module of above described, where a chromaticity distortion of the light rays emitted by the second light emitting body is in a range of −0.006-0.002.

It is possible, the light source module of above described, where the light rays emitted by the second light emitting body have continuous spectrum in a range of 620-650 nm, and a spectral intensity of the light rays located in the range is not less than a preset ratio of the spectral intensity of the first wave peak, the preset ratio is in a range of 15%-25%. It is also possible, the spectral intensity of the light rays emitted by the second light emitting body in a range of 620-650 nm is at least 21.6% of the spectral intensity of the first wave peak.

It is possible, the light source module of above described, where the light rays emitted by the second light emitting have a color temperature in a range of 7968-8868K, and a color rendering index CRI in a range of 90-96.7.

It is possible, the light source module of above described, where the light rays emitted by the second light emitting body conform to a condition in the CIE 1931 color coordinate system that the abscissa X is in a range of 0.285-0.305, and the ordinate Y is in a range of 0.289-0.309. It is also possible, the light rays emitted by the second light emitting body conform to a condition in the CIE 1931 color coordinate system that the abscissa X is in a range of 0.290-0.300, and the ordinate Y is in a range of 0.294-0.304. Additionally, it is possible, the light rays emitted by the second light emitting body conform to a condition in the CIE 1931 color coordinate system that the abscissa X is 0.2922, and the ordinate Y is 0.2940.

It is possible, the light source module of above described, where the light rays emitted by the second light emitting body have an illuminance in a range of 100-1000 lux.

It is possible, the light source module of above described, where the light rays emitted by the third light emitting body have the first wave peak with the wavelength in a range of 445-455 nm, the second wave peak with the wavelength in a range of 535-545 nm, and the third wave peak with the wavelength in a range of 615-625 nm.

It is possible, the light source module of above described, where the light rays emitted by the third light emitting body have the spectral intensity of the second wave peak in a range of 47.1%-57.1% of the spectral intensity of the first wave peak, and the spectral intensity of the third wave peak in a range of 44.9%-54.9% of the spectral intensity of the first wave peak.

It is possible, the light source module of above described, where the light rays emitted by the third light emitting body have a spectral half-width of the second wave peak in a range of 80-100 nm or in a range of 110-130 nm. It is also possible, the light rays emitted by the third light emitting body have the spectral half-width of the second wave peak in a range of 110-116 nm.

It is possible, the light source module of above described, where the light rays emitted by the third light emitting body have a spectral half-width of the third wave peak in a range of 65-85 nm or in a range of 95-115 nm. It is also possible, the light rays emitted by the third light emitting body have the spectral half-width of the third wave peak in a range of 95-99.5 nm.

It is possible, the light source module of above described, where the light rays emitted by the third light emitting body have continuous spectrum in a range of 595-660 nm, and a spectral intensity of the light rays located in the range is not less than a preset ratio of the spectral intensity of the first wave peak, the preset ratio is in a range of 25%-35%. It is also possible, the spectral intensity of the light rays emitted by the third light emitting body in a range of 620-650 nm is at least 38.1% of the spectral intensity of the first wave peak.

It is possible, the light source module of above described, where the light rays emitted by the third light emitting have a color temperature in a range of 4778-5278K, and a color rendering index CRI in a range of 90-94.5.

It is possible, the light source module of above described, where the light rays emitted by the third light emitting body conform to a condition in the CIE 1931 color coordinate system that the abscissa X is in a range of 0.336-0.356, and the ordinate Y is in a range of 0.336-0.356. It is also possible, the light rays emitted by the third light emitting body conform to a condition in the CIE 1931 color coordinate system that the abscissa X is in a range of 0.341-0.351, and the ordinate Y is in a range of 0.341-0.351. Additionally, it is possible, the light rays emitted by the third light emitting body conform to a condition in the CIE 1931 color coordinate system that the abscissa X is 0.3435, and the ordinate Y is 0.3426.

It is possible, the light source module of above described, where a chromaticity distortion of the light rays emitted by the third light emitting body is in a range of −0.017-0.011.

It is possible, the light source module of above described, where the light rays emitted by the third light emitting body have an illuminance in a range of 100-1000 lux.

An example of the present disclosure provides an illumination device, including:

a housing;

the light source module according to the preceding disclosure content, a base body of the light source module being installed to the housing;

a power module electrically connected to the light source module to provide power required by working for the light source module.

The present disclosure also provides a method of manufacturing a light source module. The method may include: providing at least one of a first light emitting body, a second light emitting body, and a third light emitting body; and configuring the first light emitting body to emit light rays having a first wave peak with a wavelength in a range of 435-465 nm and a second wave peak with a wavelength in a range of 620-650 nm, where a spectral intensity of the first wave peak is 70-90% of a spectral intensity of the second wave peak, and a condition is conformed in an International Commission on Illumination (CIE) 1931 color coordinate system that an abscissa X is in a range of 0.389-0.419, and an ordinate Y is in a range of 0.371-0.401.

The method may also include configuring the second light emitting body to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak is 25-45% of a spectral intensity of the first wave peak, and a spectral intensity of the third wave peak is 20-40% of the spectral intensity of the first wave peak, and a condition is conformed in the CIE 1931 color coordinate system that an abscissa X is in a range of 0.280-0.310, and an ordinate Y is in a range of 0.284-0.314; and configuring the third light emitting body to emit light rays having a first wave peak with a wavelength in a range of 435-465 nm, a second wave peak with a wavelength in a range of 525-555 nm, and a third wave peak with a wavelength in a range of 620-650 nm, where a spectral intensity of the second wave peak is 45-65% of a spectral intensity of the first wave peak, and a spectral intensity of the third wave peak is 40-60% of the spectral intensity of the first wave peak, and a condition is conformed in the CIE 1931 color coordinate system that an abscissa X is in a range of 0.331-0.361, and an ordinate Y is in a range of 0.331-0.361.

As seen from technical solutions provided by the examples of the present disclosure, the light source module and the illumination device using the light source module, provided by the example of the disclosure, adjust the peak wavelength, the peak intensity and the color coordinate of the light emitting body in the light source module into a preset range, so that light rays emitted by the light source module can be suitable for living environments of elderly people, and eye health of elderly people and lighting effects are considered.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The various examples in the specification are described in a progressive manner, and same or similar parts among the various examples can refer to one another, and each example focuses on illustrating differences from another examples. In particular, for a system example, because it is basically similar to a method example, description is relatively simple, and relevant parts can refer to parts of illustration of the method example.

What is described above is merely examples of the present disclosure, and is not intended to limit the present disclosure. For those skilled in the art, various modifications and changes can be made in the present disclosure. Any modifications, equivalents, substitutions, improvements, etc. made within the spirit and scope of the present disclosure all should be included within the scope of the present disclosure.

What is claimed is:

1. A light source module, comprising a first light emitting body, a second light emitting body, and a third light emitting body; wherein:

the first light emitting body is configured to emit light rays having a first wave peak with a wavelength in a range of 435-465 nm and a second wave peak with a wavelength in a range of 620-650 nm, wherein a spectral intensity of the first wave peak is 70-90% of a spectral intensity of the second wave peak, and a first condition is conformed in an International Commission on Illumination (CIE) 1931 color coordinate system that an abscissa X is in a range of 0.389-0.419, and an ordinate Y is in a range of 0.371-0.401;

the second light emitting body is configured to emit light rays having a first wave peak with a wavelength in a range of 435-465 nm, a second wave peak with a wavelength in a range of 525-555 nm, and a third wave peak with a wavelength in a range of 620-650 nm, wherein a spectral intensity of the second wave peak is 25-45% of a spectral intensity of the first wave peak, and a spectral intensity of the third wave peak is 20-40% of the spectral intensity of the first wave peak, and a second condition is conformed in the CIE 1931 color coordinate system that an abscissa X is in a range of 0.280-0.310, and an ordinate Y is in a range of 0.284-0.314;

the third light emitting body is configured to emit light rays having a first wave peak with a wavelength in a range of 435-465 nm, a second wave peak with a wavelength in a range of 525-555 nm, and a third wave peak with a wavelength in a range of 620-650 nm, wherein a spectral intensity of the second wave peak is 45-65% of a spectral intensity of the first wave peak, and a spectral intensity of the third wave peak is 40-60% of the spectral intensity of the first wave peak, and a third condition is conformed in the CIE 1931 color coordinate system that an abscissa X is in a range of 0.331-0.361, and an ordinate Y is in a range of 0.331-0.361; and the first light emitting body, the second light emitting body, and the third light emitting body are configured such that color discrimination recognized by an eye is improved.

2. The light source module of claim 1, wherein the light rays emitted by the first light emitting body conform to a condition in the CIE 1931 color coordinate system that the abscissa X is in a range of 0.394-0.414, and the ordinate Y is in a range of 0.376-0.396.

3. The light source module of claim 2, wherein the light rays emitted by the first light emitting body conform to a condition in the CIE 1931 color coordinate system that the abscissa X is in a range of 0.399-0.409, and the ordinate Y is in a range of 0.381-0.391.

4. The light source module of claim 3, wherein the light rays emitted by the first light emitting body conform to a condition in the CIE 1931 color coordinate system that the abscissa X is 0.3996, and the ordinate Y is 0.3805.

5. The light source module of claim 1, wherein a spectral half-width of the second wave peak of the light rays emitted by the first light emitting body is in a range of 65-85 nm or 95-115 nm.

6. The light source module of claim 5, wherein the spectral half-width of the second wave peak of the light rays emitted by the first light emitting body is in a range of 95-99.5 nm.

7. The light source module of claim 1, wherein the light rays emitted by the first light emitting body have continuous spectrum in a range of 485-590 nm, and a spectral intensity of the light rays located in the range is not less than a preset ratio of the spectral intensity of the second wave peak, the preset ratio is in a range of 25%-35%.

8. The light source module of claim 7, wherein the spectral intensity of the light rays emitted by the first light emitting body in the range of 485-590 nm is at least 32.5% of the spectral intensity of the second wave peak.

9. The light source module of claim 1, wherein a spectral half-width of the second wave peak of the light rays emitted by the second light emitting body is in a range of 80-100 nm or in a range of 110-130 nm.

10. The light source module of claim 9, wherein the spectral half-width of the second wave peak of the light rays emitted by the second light emitting body is in a range of 110-116 nm.

11. The light source module of claim 1, wherein, in a case where the light source module comprises the first light emitting body and the third light emitting body, spectral energy output by the first light emitting body is not less than 30% of maximum spectral energy which can be output by the first light emitting body, and spectral energy output by the third light emitting body is not less than 30% of maximum spectral energy which can be output by the third light emitting body.

12. The light source module of claim 1, wherein, in a case where the light source module comprises the third light emitting body and the second light emitting body, spectral energy output by the third light emitting body is not less than 30% of maximum spectral energy which can be output by the third light emitting body, and spectral energy output by the second light emitting body is not less than 30% of maximum spectral energy which can be output by the second light emitting body.

13. The light source module of claim 1, wherein the light rays emitted by the first light emitting body have the first wave peak with the wavelength in a range of 445-455 nm and the second wave peak with the wavelength in a range of 630-640 nm.

14. The light source module of claim 1, wherein the spectral intensity of the first wave peak of the light rays emitted by the first light emitting body is in a range of 77.1%-87.1% of the spectral intensity of the second wave peak.

15. The light source module of claim 1, wherein a chromaticity distortion the light rays emitted by the first light emitting body is in a range of −0.006-0.002.

16. The light source module of claim 1, wherein the light rays emitted by the first light emitting have a color temperature in a range of 3347-3747 K, and a color rendering index (CRI) in a range of 90-99.7.

17. The light source module of claim 1, wherein the light rays emitted by the first light emitting body have an illuminance in a range of 100-1000 lux.

18. The light source module of claim 1, wherein the light rays emitted by the second light emitting body have the first wave peak with the wavelength in a range of 445-455 nm, the second wave peak with the wavelength in a range of 535-545 nm, and the third wave peak with the wavelength in a range of 630-640 nm.

19. An illumination device, comprising:

a housing;

a light source module;

a base body of the light source module being installed to the housing; and a power module electrically connected to the light source module to provide power required by working for the light source module, wherein the light source module comprises a first light emitting body, a second light emitting body, and a third light emitting body;

wherein:

the first light emitting body is configured to emit light rays having a first wave peak with a wavelength in a range of 435-465 nm and a second wave peak with a wavelength in a range of 620-650 nm, wherein a spectral intensity of the first wave peak is 70-90% of a spectral intensity of the second wave peak, and a first condition is conformed in an International Commission on Illumination (CIE) 1931 color coordinate system that an abscissa X is in a range of 0.389-0.419, and an ordinate Y is in a range of 0.371-0.401;

the second light emitting body is configured to emit light rays having a first wave peak with a wavelength in a range of 435-465 nm, a second wave peak with a wavelength in a range of 525-555 nm, and a third wave peak with a wavelength in a range of 620-650 nm, wherein a spectral intensity of the second wave peak is 25-45% of a spectral intensity of the first wave peak, and a spectral intensity of the third wave peak is 20-40% of the spectral intensity of the first wave peak, and a second condition is conformed in the CIE 1931 color coordinate system that an abscissa X is in a range of 0.280-0.310, and an ordinate Y is in a range of 0.284-0.314;

the third light emitting body is configured to emit light rays having a first wave peak with a wavelength in a range of 435-465 nm, a second wave peak with a wavelength in a range of 525-555 nm, and a third wave peak with a wavelength in a range of 620-650 nm, wherein a spectral intensity of the second wave peak is 45-65% of a spectral intensity of the first wave peak, and a spectral intensity of the third wave peak is 40-60% of the spectral intensity of the first wave peak, and a third condition is conformed in the CIE 1931 color coordinate system that an abscissa X is in a range of 0.331-0.361, and an ordinate Y is in a range of 0.331-0.361; and the first light emitting body, the second light emitting body, and the third light emitting body are configured such that color discrimination recognized by an eye is improved.

20. A method of manufacturing a light source module comprising:

providing a first light emitting body, a second light emitting body, and a third light emitting body;

configuring the first light emitting body to emit light rays having a first wave peak with a wavelength in a range of 435-465 nm and a second wave peak with a wavelength in a range of 620-650 nm, wherein a spectral intensity of the first wave peak is 70-90% of a spectral intensity of the second wave peak, and a first condition is conformed in an International Commission on Illumination (CIE) 1931 color coordinate system that an abscissa X is in a range of 0.389-0.419, and an ordinate Y is in a range of 0.371-0.401;

configuring the second light emitting body to emit light rays having a first wave peak with a wavelength in a range of 435-465 nm, a second wave peak with a wavelength in a range of 525-555 nm, and a third wave peak with a wavelength in a range of 620-650 nm, wherein a spectral intensity of the second wave peak is 25-45% of a spectral intensity of the first wave peak, and a spectral intensity of the third wave peak is 20-40% of the spectral intensity of the first wave peak, and a second condition is conformed in the CIE 1931 color coordinate system that an abscissa X is in a range of 0.280-0.310, and an ordinate Y is in a range of 0.284-0.314;

configuring the third light emitting body to emit light rays having a first wave peak with a wavelength in a range of 435-465 nm, a second wave peak with a wavelength in a range of 525-555 nm, and a third wave peak with a wavelength in a range of 620-650 nm, wherein a spectral intensity of the second wave peak is 45-65% of a spectral intensity of the first wave peak, and a spectral intensity of the third wave peak is 40-60% of the spectral intensity of the first wave peak, and a third condition is conformed in the CIE 1931 color coordinate system that an abscissa X is in a range of 0.331-0.361, and an ordinate Y is in a range of 0.331-0.361; and configuring the first light emitting body, the second light emitting body, and the third light emitting body such that color discrimination recognized by an eye is improved.

* * * * *